United States Patent [19]

Zehr

[11] 4,138,037

[45] Feb. 6, 1979

[54] TILT CAN

[75] Inventor: William J. Zehr, Des Plaines, Ill.

[73] Assignee: The Protectoseal Co., Bensenville, Ill.

[21] Appl. No.: 836,471

[22] Filed: Sep. 26, 1977

[51] Int. Cl.[2] ..... B67D 5/64; B67D 5/04

[52] U.S. Cl. ..... 222/166; 222/472; 222/481.5; 222/180

[58] Field of Search ..... 222/465, 469, 470, 472, 222/473, 474, 478, 481, 481.5, 180, 164, 166, 167, 482, 483, 484, 487, 511, 514, 518, 525; 239/377, 378

[56] References Cited

U.S. PATENT DOCUMENTS

| | | | |
|---|---|---|---|
| 245,387 | 8/1881 | Maxfield | 222/487 |
| 505,347 | 9/1893 | Bonbrake | 222/166 X |
| 616,016 | 12/1898 | Ross | 222/164 X |
| 1,865,269 | 6/1932 | Munday | 222/474 X |
| 2,086,219 | 7/1937 | Geyser | 222/518 X |
| 2,172,142 | 9/1939 | Lebus | 222/518 X |
| 2,764,318 | 9/1956 | Lisciani | 222/487 X |

*Primary Examiner*—Robert B. Reeves
*Assistant Examiner*—Edward M. Wacyra
*Attorney, Agent, or Firm*—Rummler & Snow

[57] ABSTRACT

A tilt can or container for pouring flammable liquids having means for simultaneously venting the can when opening the pouring spout.

6 Claims, 7 Drawing Figures

TILT CAN

SUMMARY OF THE INVENTION

A tilt can having a pivoted means for simultaneously venting the can upon opening the pouring spout whereby flammable liquids are poured therefrom into a small container and when the means is released by the user, the can will return to upright position and the pouring spout and vent are automatically closed simultaneously and sealed.

DETAILED DESCRIPTION OF THE DRAWINGS

Figure 1:
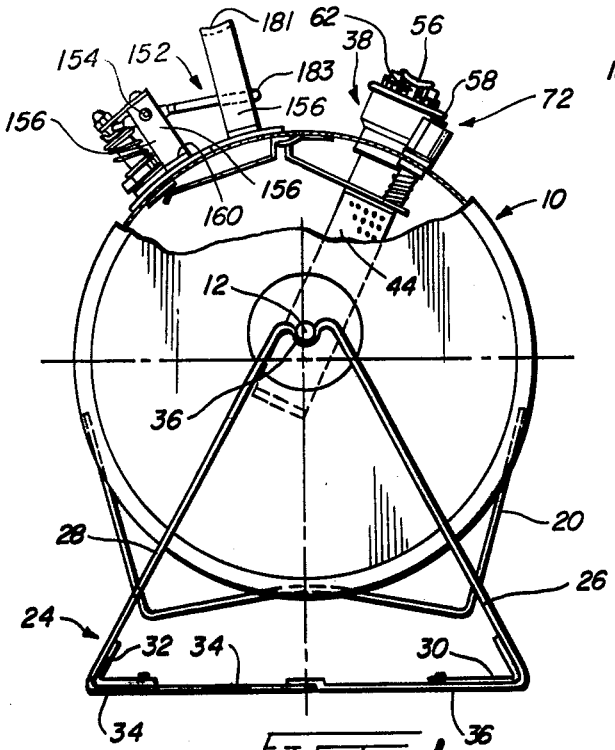
FIG. 1 is a side elevational view of the invention with parts shown broken away.

The tilt can of the present invention comprises a cylindrical can 10 having short pivot rods 12, 14 extending laterally of the end walls 16, 18 of the can, with one end of the rods secured to the respective side walls along the horizontal axis of the can. It is to be noted that the pivot rods are positioned on the vertical centerline but upwardly of the horizontal centerline shown in dash lines, as shown in FIG. 1. A pair of spaced legs 20, 22 are secured to the body of the can to support the can in upright position when not used in a cradle.

A cradle 24 comprises pairs of spaced triangular-shaped legs 26, 28 and each having a bottom leg 34. The legs are anchored together with spacer support angle-bars 30, 32 which are anchored to the bottom legs 34 and the lower ends of side legs 26, 28, respectively, at the ends of said bars 30, 32 and inside the legs. The apex of said members 26, 28 are bent downwardly to form a semicircular seat 36 for the pivot rods 12, 14, respectively, whereby the can 10 may rotate on said seat 36.

FILLER SPOUT

The cylindrical filling spout 38 has an enlarged upper portion 40 extending above the can body 10 and provided with an axially offset tube 42 anchored to the can body. The tube 42 partially extends interiorly into the can and a cylindrical flash arrester 44 is secured thereto and extends inwardly below the horizontal axis of the rods 12, 14. The fill spout 38 is positioned offset from the vertical centerline of the can, as shown in FIG. 1.

Figure 2:
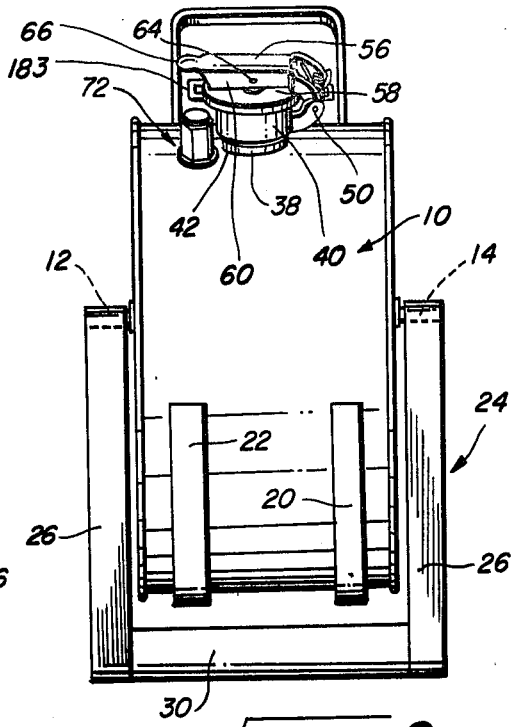
FIG. 2 is a side elevational view of the device of FIG. 1.

The upper portion 40 is provided with a bracket having a pair of outwardly projecting ears 46, 48. (See FIG. 3.) The bracket is anchored to the outer side wall of the upper portion 40. The ears have perforations in the free ends to support a spring loaded pintle 50 and also supporting a second pair of ears 52, 54 which are anchored to lever 56 for opening and closing the cover 58. The lever has depending legs 60 extending from the sides of the lever. (See FIGS. 2 and 3.) A rod 62 is pivotally anchored to the cap or cover 58 medially, and extends upwardly to seat between the legs 60 and the upper end of the rod is pivoted thereto by rivet 64. The lever is provided with a flared portion 66 at its free end for lifting the cover to fill the can 10. The lower face of the cap 58 is provided with a gasket to prevent leakage of the contents.

It should now be apparent that the spring 68 tends to keep the cap 58 tight on its seat except when a pressure build occurs in the can, the pressure will cause the cap 58 to raise slightly to relieve such pressure.

Vent Valve

Figure 5:
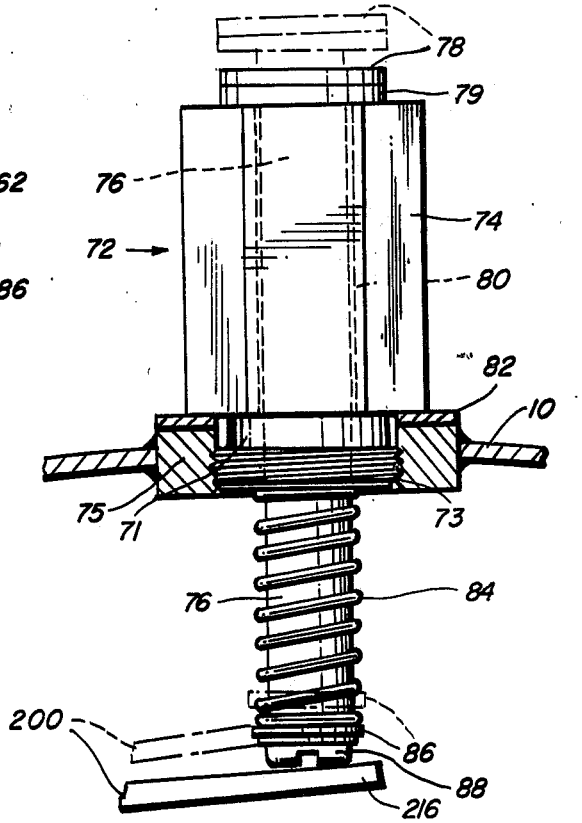
FIG. 5 is a side elevational view of the vent valve with parts in cross-section.

Located adjacent the flared portion 66 of the lever 56 and below and to one side is a vent valve assembly 72 (see FIG. 5) positioned on the can to the right about 30° from the vertical centerline, as shown in FIG. 1, and comprising an elongated housing 74 of hexagonal shape having an axial bore 80. The lower end 71 of said housing is axially reduced and threaded as at 73 to be anchored in the threaded sleeve 75 in the can body. The sleeve is welded to the can to form a liquid tight seal. The housing 74 includes an elongated stem 76 substantially longer than the housing 74, loosely positioned axially in said bore 80, as shown in FIG. 5. The stem is provided with a head 78 anchored to the upper end of the stem 76 with a gasket 79 positioned therebelow to lie against the upper wall of said housing 74 to close off the axial bore 80. A washer 82 is positioned between the lower end of the housing 74 and the sleeve 75.

The lower end of the stem 76 is provided with a spring 84 and surrounds the same with one end bearing against the bottom wall of the lower end 71 and the other end of the spring bearing against a washer 86 which is held in place by the flat headed machine screw 88 which is threaded axially in the lower end of the stem 76.

Thus, when the stem is urged upwardly, the interior of the can will be vented. The moving force will be hereinafter described.

Discharge Spout

Figures 4, 6, 7:
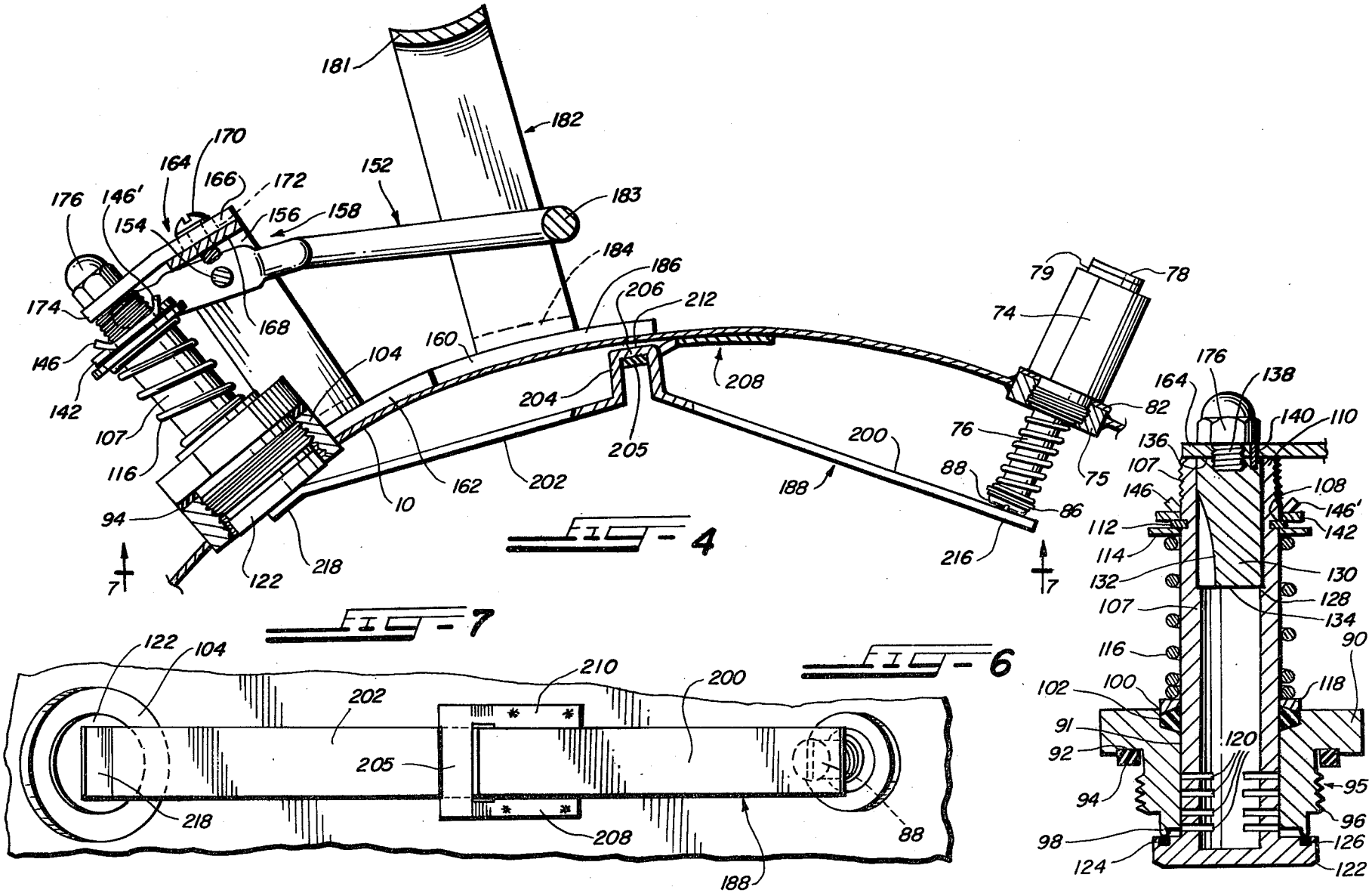
FIG. 4 is a cross-sectional view taken on the lines 4—4 of FIG. 3.
FIG. 6 is an enlarged view of the pouring spout.
FIG. 7 is an elevational view taken on the lines 7—7 of FIG. 4.

The hollow spout assembly comprises a housing 90 bored axially as at 91 positioned on and extending above said can 10, the outer walls being hexagonal in shape. The housing is positioned on said can body about 40° to the left of the vertical centerline, as shown in FIG. 1. The body is provided with a seat 92 to receive a gasket 94 on its under side. The lower end 95 of said housing is reduced axially and provided with male threads 96 and an integrally-formed marginal cylindrical ring 98 below the threads. (See FIG. 6.) The housing is also provided with an axial cutout 100, as shown in FIG. 6, to house a cylindrical V-gasket 102.

A cylindrical sleeve 104 is welded in a liquid tight seal to said can 10 and contains female threads 106 to receive the male threads 96 of the body and when assembled, the gasket 94 will lie against the upper wall of the sleeve 104.

The spout assembly also includes a hollow tubular member 107 slidable in said housing 90. The member 107 is provided with a cylindrical groove 108 on its exterior wall below its head 110 to receive a slip retaining ring 112. A washer 114 bears against the ring 112 which acts as a seat for the upper end of spring 116. The lower end of the spring bears against a packing sleeve 118. As seen in FIG. 6, the packing sleeve bears against the gasket 100.

The lower end of the member 107 is provided with a series of horizontal slits 120 positioned one above the other to provide for slow movement of the flammable liquid through the spout and prevent a surge of fluid expelling from the spout. As seen in FIG. 6, the slits 120 partially extend through the wall of the hollow member 107. Below the lowermost slit 120, an intergrally-formed enlarged cap or bearing plate 122 is formed on the lowermost portion of member 107. The diameter of the cap 122 is larger than the diameter of the member 107 and is provided with a cylindrical seat 124 adjacent its margin to receive a gasket 126 which is arranged to bear against the ring 98 to seal the spout assembly and prevent the flammable liquid from flowing therethrough by action of the spring 116.

The member 107 has a seat 128 formed interiorly thereof to bottom out the stationary valve plug 130. (See FIG. 6.) The plug is solid except for the vertical arcuate cutout 132 extending from the bottom wall 134 to just below the top wall 136 to form a passageway for the flammable fluid when the spout is opened. An integrally-formed, elongated, threaded cylindrical rod 138 extends upwardly axially from the top wall of the plug 130 and is exteriorly threaded. The rod is substantially 3/16 inches in diameter and ⅜ inches in height.

A small pin 140 is anchored in a bore in the top wall 136 adjacent the margin thereof and extends upwardly from the top wall 136. A clip 142 has a perforation slightly larger in diameter than the diameter of member 107 to loosely slip over the upper end of the hollow member 107 and seat on the retaining ring 112. The clip has pairs of laterally-extending arms 146, 146' on which seat the inwardly-extending portions 150 of the pivoted operating handle 152 which operates the pouring spout. Each arm has upwardly- and outwardly-extending marginal portions to retain the clip in operative position relative to the portions 150.

The legs of the operating handle 152 are pivotally secured by a pintle 154 to the side walls 156 of U-bracket 158. The bracket has a pair of laterally-extending flanges 160 at its lower end spot welded to an arcuate plate 162 which itself is spot welded to the exterior surface of the can body 10.

A plate or bar 164 has a flat portion 166 secured to the connector leg 168 of the U-bracket 158 by a screw 170 extending through an elongated adjusting perforation 172. The other end 174 of plate 164 extends downwardly at an angle of about 7° and has a perforation 175 therein to receive the threaded rod 138 of the plug 130 and be anchored thereto by an acorn nut 176. Thus the plug 130 becomes stationary. A second perforation 178 is provided just behind the perforation 175 in the angled other end 166 to receive the pin 140 of the valve plug 130. Thus the cutout 132 in the plug 130 always remains in pouring position.

Figure 3:
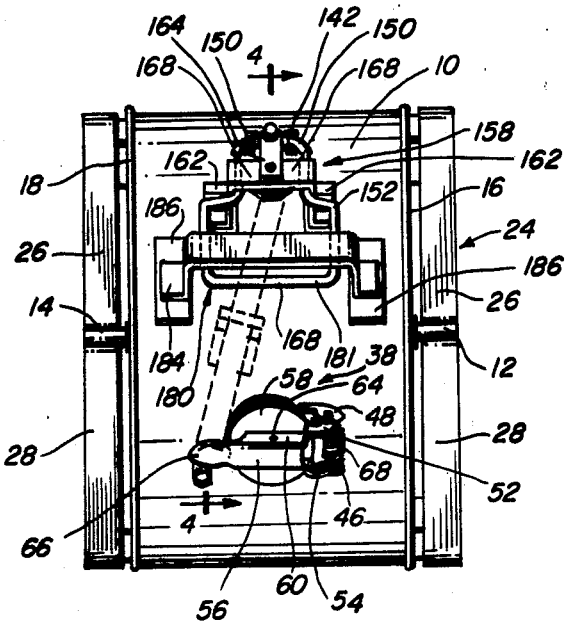
FIG. 3 is a top elevational view of the device of FIG. 1.

The large part of the movable handle 152 extends rearwardly under and slightly beyond the carrying handle 182 which is U-shaped having laterally-extending flanges 184 spot welded to an arcuate plate 186 which itself is spot welded to the can, as shown in FIG. 3. The movable handle is positioned between the side legs and under the connecting leg 181 of handle 182.

To open the vent valve 72, a one-piece rocking lever 188 comprises a pair of angular elongated arms 200, 202 bent substantially medially into a U-shaped straddle 204 to pivot on a generally flat U-shaped connector leg 206. The lever bracket itself comprises a pair of arcuate arms 208, 210 contouring the inner walls of the can 10 and anchored thereto with the connector leg 206 bent downwardly angularly, forwardly of the arms 208, 210, and terminating in a flat pivot portion 205 on which the connector arm 206 of the U-shaped straddle 204 of the lever pivots. The terminal end 216 of the arm 200 seats below and is engaged by the head of the screw 88 and becomes the moving force for shifting the stem 76 upwardly to vent the interior of the can upon tilting of the arm 200.

The arm 202 terminates in about a 30° bend to be under the cap 122 of the spout assembly whereby when the member 107 is shifted downwardly by the operating handle 152, it will push the arm 202 at 218 downwardly about the pivot 205 thereby raising the arm 200 upwardly at the end 216 against the screw head 88 to cause the stem 76 to move upwardly unseating the head 78 to open the vent.

In operation, when a person desires to fill a small container from the larger supply in the tilt can 10, the fingers of the hand reach under the connector leg 181 of the larger end of handle 182 with the heel of the palm of the hand lying on the connector leg 181 and grasp the connecting leg 183 of the operating handle 152.

The can is tilted simultaneously with the upward movement of the connector leg 183 by the fingers. This will push the hollow member 107 downwardly (through clip 142 bearing on the retaining ring 112) breaking the seal (ring 98, gasket 126) and lower the cap 122 allowing the flammable liquid in the can 10 to flow through the slits 120 slowly upwardly and through the cutout 132 of the stationary valve plug 130 and into the small container.

Simultaneously, upon depression of the member 107, its cap 122 will depress the lever 188 at 218 shifting it downwardly about its pivot 205 and the end 216 will bear against the head of screw 88 shifting the stem 76 of the vent upwardly to vent the can 10 through bore 80.

When the hand of the person filling the smaller container is removed, the can will automatically return to the upright position, as shown in FIG. 1, because of the offset pivot rods 12, 14 and the fluid in the tank. The spout will be closed by spring 116 sealing the spout at gasket 126. The vent will also be simultaneously closed off at the gasket 79 under action of spring 84.

It is to be understood that numerous details shown and described may be altered or omitted without departing from the spirit of this invention as defined by the following claims.

I claim:

1. A tilt fill can assembly for flammable liquid having automatic venting when pouring spout is opened comprising:

a can having side walls and a cylindrical wall between, (1) said side walls having pivot rods extending outwardly of the can side walls offset from the horizontal axis of the can and in the vertical axis thereof, and supporting legs therefor;

(2) a pair of spaced triangularly shaped frames, the apex being bent inwardly to form a seat for said rods;

(3) a carrying handle for said can mounted thereon;

(4) a pouring spout positioned on said can offset from said handle;

(5) a filler spout assembly on said can offset from said handle and on the side opposite that of the pouring spout;

(6) a vent valve assembly on said can adjacent said filler spout;

(7) a second handle for opening said pouring spout with a portion seated interiorly of said carrying handle; and (8) elongated pivoted lever means interior of said can operable when said pouring spout is opened to automatically open said vent valve.

2. The device according to claim 1 wherein the pouring spout comprises a hollow housing removably secured to said cylindrical wall of said can, a hollow, tubular, spring loaded member slidable in said housing extending interiorly in said can, a cap on the lower end of said member contacting one end of said lever means, a stationary plug in the upper end of said member having a cutaway portion acting as an outlet, and means on said second handle to shift said member downwardly.

3. A device according to claim 2 wherein the vent valve comprises a housing anchored to said can, a spring loaded stem loosely positioned in said housing and having a portion extending below said housing and interiorly of said can, said portion in said can having a bearing plate thereon against which the other end of said lever bears to raise said stem when said member of said spout is depressed against the lever.

4. A device according to claim 3 wherein said elongated lever means is medially loosely pivoted interiorly of said can and comprises a pair of integrally formed arms extending downwardly angularly from the pivot, the distal ends of said arms abutting the cap of said pouring spout and the bearing member of said vent valve stem.

5. The device according to claim 2 wherein the lower end of the hollow tubular member is provided with a horizontal series of slits in the lower end thereof positioned one above the other and through which the flammable fluid in the can enters the interior of the tubular member.

6. The device according to claim 2 wherein a clip is positioned on said tubular member adjacent its upper end, the second handle lying substantially in a horizontal plane, pivoted to an inverted U-bracket and having a pair of free ends, said handle ends bent at right angles, and each to seat on said clip to shift said member downwardly.

* * * * *